US006831573B2

(12) United States Patent
Jones

(10) Patent No.: US 6,831,573 B2
(45) Date of Patent: Dec. 14, 2004

(54) SAFETY VEHICLE AND SYSTEM FOR AVOIDING TRAIN COLLISIONS AND DERAILMENTS

(76) Inventor: Thomas L. Jones, 11 Yorkshire St., Asheville, NC (US) 28803

( * ) Notice: Subject to any disclaimer, the term of this patent is extended or adjusted under 35 U.S.C. 154(b) by 0 days.

(21) Appl. No.: 10/270,330

(22) Filed: Oct. 15, 2002

(65) Prior Publication Data

US 2004/0073366 A1 Apr. 15, 2004

(51) Int. Cl.[7] ..... G08G 1/16

(52) U.S. Cl. ..... 340/903; 340/436; 701/19; 701/301; 286/167 R

(58) Field of Search ..... 340/903, 933, 340/435, 436; 701/19, 301; 246/122 R, 167 R, 187 C

(56) References Cited

U.S. PATENT DOCUMENTS

| | | | | |
|---|---|---|---|---|
| 4,578,665 | A | * 3/1986 | Yang | 246/166.1 |
| 5,429,329 | A | * 7/1995 | Wallace et al. | 246/166 |
| 5,574,469 | A | * 11/1996 | Hsu | 342/455 |
| 5,627,508 | A | * 5/1997 | Cooper et al. | 340/425.5 |
| 5,986,547 | A | 11/1999 | Korver et al. | |
| 6,216,985 | B1 | 4/2001 | Stephens | |
| 6,273,341 | B1 | 8/2001 | Debabi | |
| 6,293,205 | B1 | 9/2001 | Butler | |
| 6,322,025 | B1 | 11/2001 | Colbert et al. | |
| 6,373,403 | B1 | 4/2002 | Korver et al. | |
| 6,402,094 | B1 | 6/2002 | Beer | |
| 6,405,127 | B1 | 6/2002 | Doner | |
| 6,408,766 | B1 | 6/2002 | McLaughlin et al. | |
| 6,411,870 | B1 | 6/2002 | Sato | |
| 6,412,332 | B1 | 7/2002 | Bartonek | |
| 6,415,208 | B1 | 7/2002 | Pojda | |
| 6,658,355 | B2 | * 12/2003 | Miller et al. | 701/301 |
| 2001/0002688 | A1 | 6/2001 | Uebel | |
| 2001/0044695 | A1 | 11/2001 | Doner | |
| 2002/0065629 | A1 | 5/2002 | Clark et al. | |

* cited by examiner

*Primary Examiner*—Toan N. Pham
(74) *Attorney, Agent, or Firm*—Connolly, Bove, Lodge & Hutz LLP

(57) ABSTRACT

A system for preventing trains from derailing and colliding with hazards on railways is disclosed. According to the invention, the system includes a safety vehicle (i.e., "trolley") that travels along a railway a head of a train. The train and trolley each include GPS receivers which constantly provide GPS location information to a computer in the train. The computer calculates the distance between the trolley and the train, speed at which the train is traveling, and the distance required for the train to stop. The computer transmits acceleration and deceleration commands to the trolley and/or train to maintain a safe distance between the trolley and the train. If the trolley derails, stops or slows down due to a hazard on the railway or another problem, the computer generates commands to slow down or stop the train, as necessary, to prevent the train from derailing or colliding with the trolley or a hazard on the railway.

4 Claims, 3 Drawing Sheets

SAFETY VEHICLE AND SYSTEM FOR AVOIDING TRAIN COLLISIONS AND DERAILMENTS

TECHNICAL FIELD

The present invention relates to safety improvements in rail transportation. Specifically, a system is provided for avoiding train derailments and collisions with objects.

BACKGROUND OF THE INVENTION

Trains are important vehicles for shipping goods and transporting people. Since trains often carry large amounts of passengers, cargo or toxic chemicals, train accidents and derailments can be huge disasters. Furthermore, because of the number of passengers and amounts and types of cargo trains carry, as well as the distances and terrain they traverse, trains are particularly attractive targets for terrorist attacks and other criminal attacks. In particular, trains are susceptible to accidents or attacks involving foreign objects, explosive devices and damaged sections of track on railways. Trains may collide with foreign objects, encounter explosive devices or travel over damaged sections of track, causing serious damage to the train and possibly derailment of the train. Serious injuries to passengers, fatalities and damage to goods aboard trains can result from such incidents.

It is therefore desirable to provide improved methods and devices for avoiding train collisions and derailments from colliding with objects and derailing.

BRIEF SUMMARY OF THE INVENTION

The present invention provides a vehicle and system for preventing train accidents and derailments. More specifically, the present invention provides a safety vehicle that proceeds along a railway ahead of a train and prevents the train from colliding with hazards on the railway and derailing.

The safety vehicle and train each include a GPS receiver that continuously receives GPS location information and transmits the GPS location information to a computer in the engineering control room of the train. Based on the GPS location information, the computer registers the locations of the safety vehicle and the train, and then calculates the distance between the safety vehicle and the train. The computer calculates the speed at which the train is traveling and then calculates the stopping distance needed by the train based on the speed at which the train is traveling and the estimated weight of the train.

The computer sends acceleration and deceleration commands to the safety vehicle and/or train to control the acceleration and deceleration of the safety vehicle and/or train in order to maintain a desired distance between the safety vehicle and the train. The desired distance between the safety vehicle and the train is a distance greater than the distance required for the train to stop. The computer thereby keeps the safety vehicle far enough ahead of the train to allow the train to stop prior to reaching the safety vehicle should the safety vehicle impact an object, derail or detonate an explosive device on the railway ahead of the train, yet close enough to the train to maintain communication between the safety vehicle and the train.

The safety vehicle may be further equipped in one embodiment of the invention with a status transmitter that constantly transmits a status signal to a status receiver connected to the computer. In the event that the safety vehicle is damaged by an explosive device or an object such that the status transmitter is destroyed, the status transmitter stops transmitting the status signal. The computer then detects that the status signal is no longer being received by the status receiver and issues electronic commands to cause the train to stop.

If the safety vehicle stops for any reason, the computer recognizes that the safety vehicle is stopped based on the GPS location information associated with the safety vehicle. The computer then issues electronic commands to cause the train to stop.

According to another embodiment of the invention, the safety vehicle may be equipped with video cameras to give train operators a view of the railway ahead of the train. Video captured by the video cameras is transmitted to video monitors in the engineering control room for viewing by the train operators.

According to yet another embodiment of the invention, the safety vehicle may be equipped with front and rear bumpers constructed of energy absorbing materials to minimize damage in a collision.

The invention, along with additional features and advantages thereof, may be best understood with reference to the following detailed description and accompanying drawings.

DETAILED DESCRIPTION OF THE INVENTION

The present invention relates novel devices and methods for preventing trains from derailing. The invention is described in detail in the following paragraphs with reference to a preferred embodiment shown in FIGS. 1–3.

Figure 1:
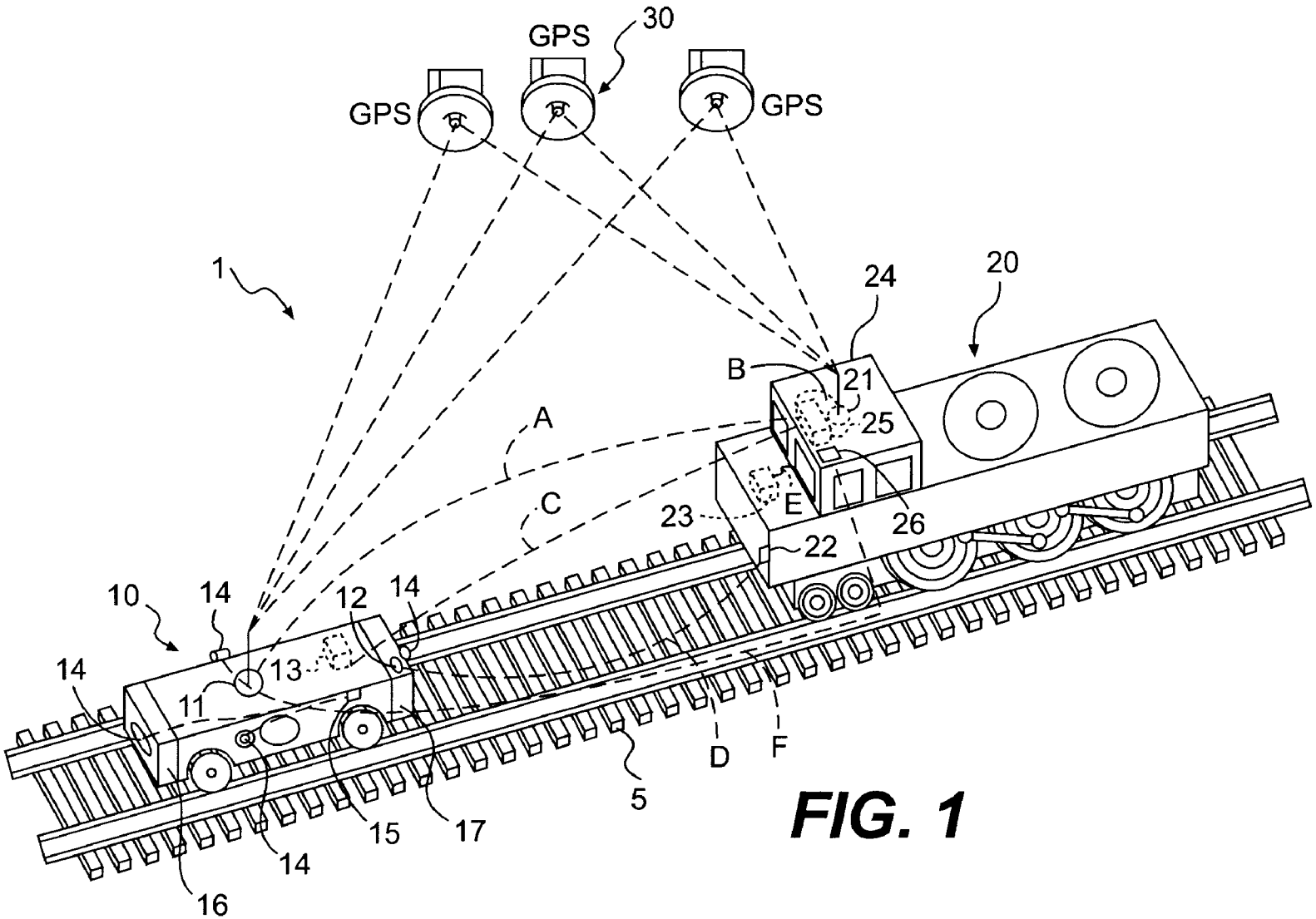
FIG. 1 illustrates a system for preventing trains from derailing including a novel safety vehicle and train according to one embodiment of the invention.

FIG. 1 shows one embodiment of a system 1 for preventing train accidents. The system 1 is designed to prevent a train from derailing or colliding with hazards on a railway. As shown in FIG. 1, the system 1 includes a first, safety vehicle or trolley 10 and a second vehicle or train 20 that traverse a pathway or railway 5. The trolley 10 travels along the railway 5 ahead of the train 20. According to one embodiment of the invention, the trolley 10 may be an unmanned, remote-controlled vehicle.

The trolley 10 includes a trolley control unit 13. The trolley control unit 13 interfaces with and controls various components of the trolley including, but not limited to, throttle and braking mechanisms.

Figure 2:
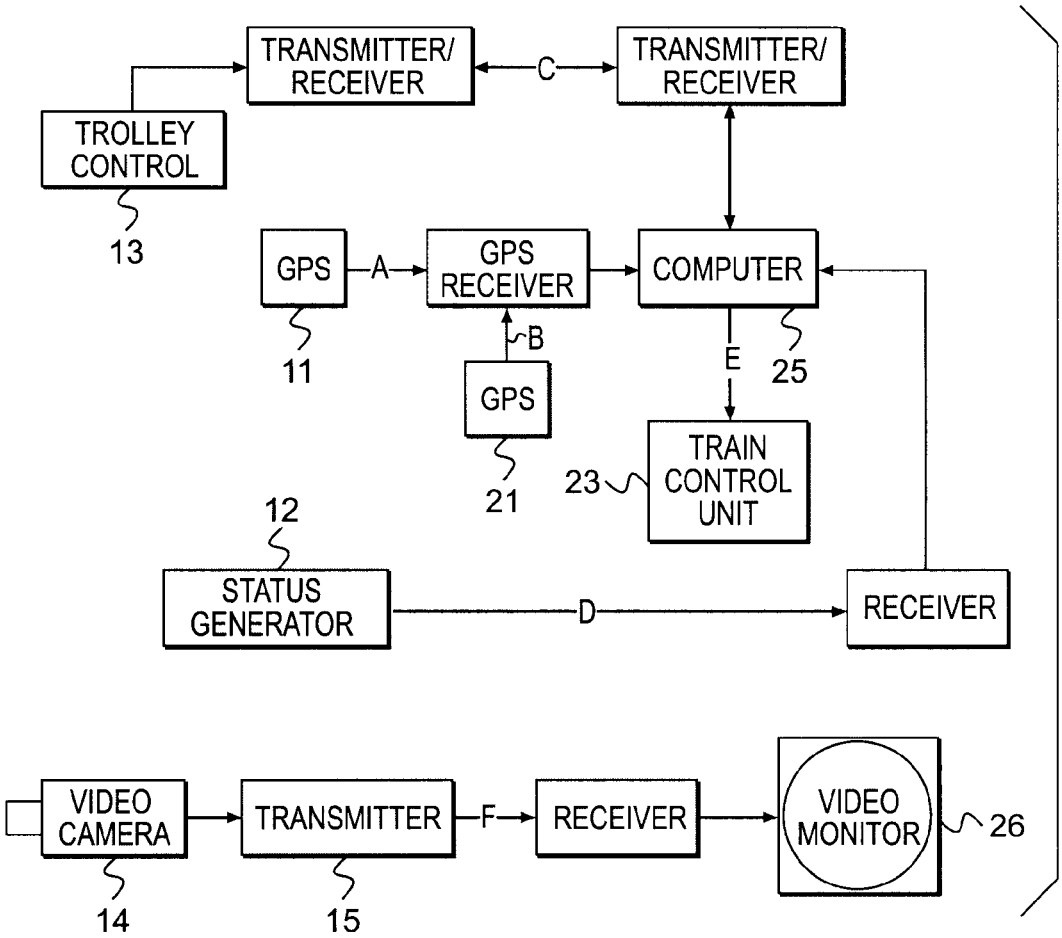
FIG. 2 is a block diagram of a preferred embodiment of the system.

FIG. 2 shows a block diagram of the system components. The train 20 includes a computer 25 that communicates with the trolley 10 and the train 20. Although the computer may be located anywhere on the train 20, it is preferably located in an engineering control room 24 of the train 20. The train further includes a train control unit 23 that interfaces with and controls various components of the train including, but not limited to, throttle and braking mechanisms. The computer 25 communicates with the trolley control unit 13 via a wireless communication link C and communicates with the train control unit 23 via an electronic pathway E. More specifically, the communication link C is established by a wireless electronic transmitter/receiver of the computer 25 and a wireless electronic transmitter/receiver of the trolley control unit 13. The electronic pathway E is established by a wired or wireless electronic transmitter/receiver of the computer 25 and a corresponding wired or wireless electronic transmitter/receiver of the train control unit 23.

Figure 3:
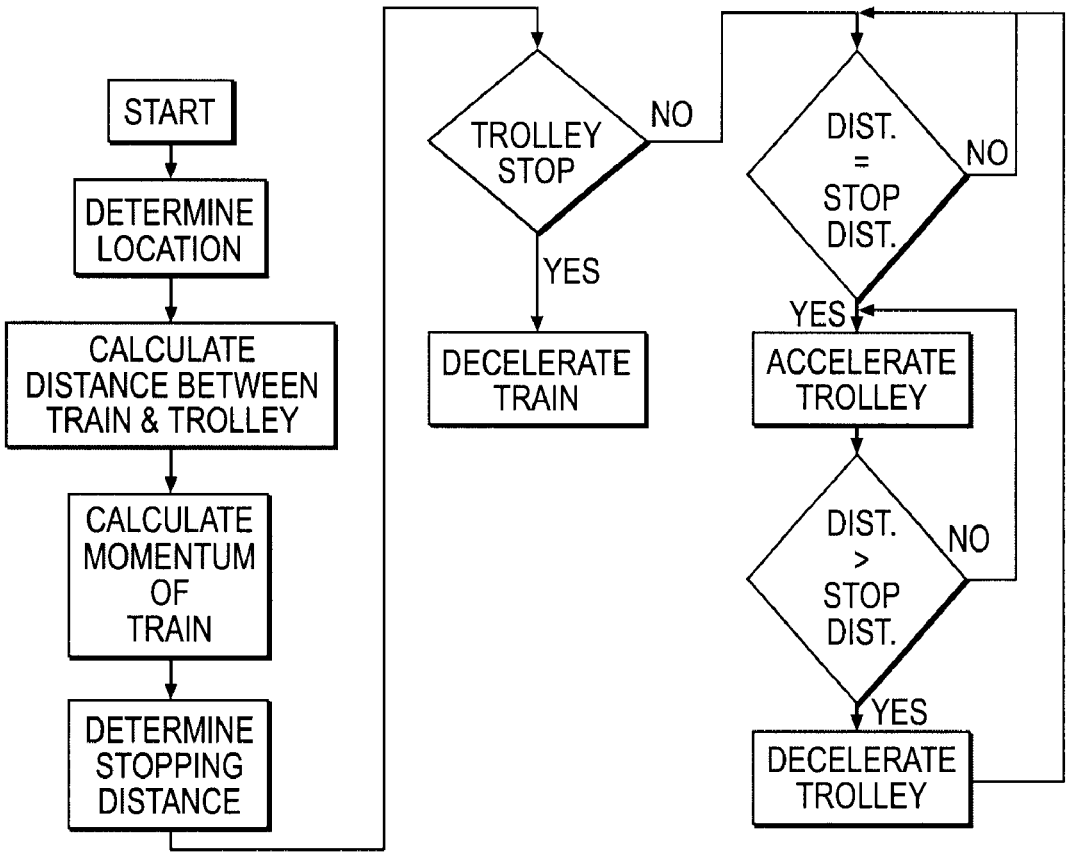
FIG. 3 is a flow chart of a computer program for a computer of the system.

The trolley 10 includes a first GPS unit 11 that continuously receives GPS location information associated with the trolley 10 from GPS satellites 30. The train 20 includes a second GPS unit 21 that continuously receives GPS location information associated with the train 20 from the GPS satellites 30. The first and second GPS units 11 and 21 include electronic transmitters (not shown) for transmitting GPS location information to the computer 25 via communication links A and B, respectively. The transmitters for the first GPS unit 11 may be wireless transmitters, while the transmitters for the second GPS unit 21 may be wired or wireless transmitters. Accordingly, the computer 25 includes electronic receivers for receiving GPS location information from the GPS units 11, 21. The operation of the system 1, which is illustrated in FIG. 3, will now be described in detail.

The first and second GPS units 11, 21 continuously transmit their respective GPS location information to the computer 25 via the communication links A and B, respectively. Based on the GPS location information received from the GPS receivers 11, 21, the computer continuously registers the location of the trolley 10 and the location of the train 20 along the railway 5, and then calculates the distance between the trolley 10 and the train 20. Thus, the computer 25 is aware of the relative locations of the trolley 10 and the train 20 at all times.

As the computer 25 calculates the distance between the trolley 10 and the train 20, the computer 25 calculates the speed at which the train 20 is traveling. This can be done based on changes in the GPS location information associated with the train 20 over a preselected period of time, or based on readings from a speedometer (not shown). Additionally, the computer 25 records the estimated weight of the train 20. Based on the estimated weight of the train and the speed at which the train 20 is traveling (i.e., the momentum of the train), the computer 25 continuously calculates the stopping distance needed by the train.

If the train 20 should approach the trolley 10 within a distance near the stopping distance required by the train 20, the computer 25 generates an acceleration command instructing the trolley 10 to accelerate and transmits the acceleration command to the trolley control unit 13 via the communication link C. The trolley control unit 13 then causes the trolley 10 to accelerate by adjusting the throttle for the trolley 10. Once the trolley 10 is ahead of the train 20 by a distance greater than the stopping distance required by the train 20, the computer 25 stops generating the acceleration command and generates a deceleration command as needed to slow down the trolley 10. Thus, the computer 25 controls progress of the train 20 along the railway 5 such that the train 20 remains behind the trolley 10 by a desired, safe distance.

On the other hand, should the trolley 10 advance ahead of the train 20 by a distance greater than a preselected maximum distance, the computer 25 generates a deceleration command, which is transmitted to the trolley control unit 13 via the communication link C. The trolley control unit 13 then causes the trolley 10 to decelerate by adjusting the throttle and/or applying the brakes of the trolley 10. Once the trolley 10 is ahead of the train 20 by a distance less than the preselected maximum distance, the computer 25 stops generating the deceleration command.

In attempting to maintain a desired distance between the trolley 10 and the train 20, the computer 25 may generate acceleration or deceleration commands to control acceleration and deceleration of the train 20 in addition to or instead of generating acceleration or deceleration commands to control acceleration and deceleration of the trolley 10. For example, increase the distance between the trolley 10 and the train 20, the computer 25 may, in addition to or instead of generating an acceleration command for the trolley 10, generate a deceleration command for the train 20 and transmit the deceleration command to the train control unit 23 via pathway E. In response to the deceleration command, the train control unit 23 would slow down the train 20 by cutting back the throttle of the train 20 and/or applying the brakes of the train 20. In contrast, to decrease the distance between the trolley 10 and the train 20, the computer 25 may, in addition to or instead of generating a deceleration command for the trolley 10, generate an acceleration command for the train 20 and transmit the acceleration command to the train control unit 23 via pathway E, whereby the control unit 23 would speed up the train 20 by adjusting the throttle of the train 20.

The trolley 10 is further equipped with a status transmitter 12 that transmits a status signal to a status receiver 22 on the train 20 via a wireless communication link D. The status receiver 22 is in communication with the computer 25 via pathway F. Thus, the computer 25 is able to detect the status signal and verify the presence of the trolley 10 on the railway 5 based on the status signal. If the trolley 10 derails, collides with an object on the railway 5 or receives damage from an explosive device on the railway 5 such that the status transmitter 12 is rendered inoperative, the computer 25 detects that the status signal is no longer being transmitted, generates a stop command and transmits the stop command to the train control unit 23 via pathway E. In response to the stop command, the train control unit 23 cuts off the throttle of the train 20 and applies the brakes of the train 20 to bring the train 20 to a stop. Therefore, the train 20 does not collide with the trolley 10 or receive damage from the object or device that damages the trolley 10.

In some cases, the trolley 10 may stop on the railway 5 due to technical problems, derail without damaging the status transmitter 12 or otherwise incur damage and come to a stop without causing damage to the status transmitter 12. In such cases, the computer 25 receives stationary location information (i.e., location information that remains unchanged over a preselected period of time) from the first GPS receiver 11 and detects stoppage of the trolley 10. The computer 25 then generates a deceleration command and transmits the deceleration command to the train control unit 23 via pathway E. In response to the deceleration command, the train control unit 23 cuts off the throttle and/or applies the brakes of the train 20 to slow down or stop the train 20 until the trolley 10 begins to move again and advances past a desired distance between the trolley 10 and the train 20, or until the problem causing the stoppage or derailment of the trolley 10 is resolved.

As can be understood from the preceding description, the system 1 reduces the likelihood that the train 20 will derail or collide with objects and devices on the railway 5 by forcing the train 20 to remain behind the trolley 10 by a safe distance. In the event that the trolley 10 stops or derails for any reason, the train 20 is able to slow down or stop such that it does not collide with the trolley 10 or any object or device on the railway 5 that presents danger.

The trolley 10 may include one or more video cameras 14. Preferably, the trolley 10 is equipped with four video cameras 14, with one camera being mounted to each side of the train. The trolley 10 further includes a wireless video transmitter 15 that transmits video captured by the cameras 14 to at least one video monitor or display 26 in the engineering control room 24 via pathway F. The video monitor 26 may include a wireless receiver for receiving the captured video. Therefore, an engineer or crew member in the engineering control room 24 can view the monitor 26 to check for hazards on the railway 5.

The trolley 10 may also be equipped with a front bumper 16 disposed at the front end of the trolley 10 and a rear bumper 17 disposed at the rear end of the trolley 10. The bumpers 16 and 17 are constructed from an energy absorbing material and energy absorbing components for minimizing damage to the trolley 10 during a collision.

According to other embodiments of the invention, the system 1 can be a passive control system, in which a train engineer or other operator can manually control the acceleration, deceleration and/or stoppage of the trolley 10 or train 20 based on the receipt or non-receipt of one or more signals generated in response to the information calculated by the computer 25. More specifically, the system 1 can be adapted to operate substantially as described above, except that instead of generating commands to control the progress of the trolley 10 and train 20, the computer 25 can simply generate information signals based upon the location information and other information collected and/or calculated as described above. The signals may comprise light signals, audio signals, images or other electronic signals that can be converted to output readable by an operator through output devices (not shown) such as lights, audio speakers, video monitors or gauges. Thus, the operator can manually control the progress of the trolley 10 and/or train 20 based upon the output of the output devices. For example, the computer may generate a warning signal if the trolley 10 and train 20 are too close to one another or if the status signal from the trolley 10 is no longer detected by the computer 25, and the warning signal may be output in the form of a light, a sound, an image on a screen, or a reading on a gauge. The operator can then manually control the progress of the train 20 or trolley 10 as necessary.

Although the present invention has been described in the context of a train system, it should be understood that the concepts and devices described herein can be applied to other modes of transportation including vehicles that traverse fixed pathways.

The foregoing has described a system for avoiding train derailments and collisions with objects. While the invention has been illustrated in connection with preferred embodiments, variations within the scope of the invention will likely occur to those skilled in the art. Thus, it is understood that the invention is covered by the following claims.

I claim:

1. A system for preventing train accidents, said system comprising:

a train disposed on a railway, said train including a computer, a first GPS unit and a status receiver;

a safety vehicle disposed ahead of said train on said railway, said safety vehicle including a second GPS unit and a status transmitter, wherein:

said first GPS unit is adapted to continuously receive first location information associated with said train and is adapted to continuously transmit said first location information to said computer;

said second GPS unit is adapted to continuously receive second location information associated with said safety vehicle and is adapted to continuously transmit said second location information to said computer;

said status transmitter is adapted to transmit a status signal to said status receiver, and said status receiver is in communication with said computer;

said computer is adapted to continuously calculate a location of said train based on said first location information and is adapted to continuously calculate a location of said safety vehicle based on said second location information;

said computer is adapted to generate commands controlling at least one of acceleration and deceleration of said train or said safety vehicle in order to maintain a desired distance between said train and said safety vehicle; and said computer is adapted to detect said status signal and is adapted to generate a command to stop said train if said computer fails to detect said status signal.

2. The system of claim 1, wherein said computer is adapted to detect stoppage of said safety vehicle based upon the location of said safety vehicle remaining unchanged over a preselected period of time, and wherein said computer is adapted to generate a command to slow down or stop said train upon detecting stoppage of said safety vehicle.

3. The system of claim 1, wherein said safety vehicle includes at least one video camera adapted to capture video images of the railway and to transmit said video images to at least one video monitor in said train.

4. The system of claim 1, wherein said safety vehicle includes bumpers located at front and rear ends of said safety vehicle, and wherein said bumpers are constructed of an energy-absorbing material.

* * * * *